US007387494B2

(12) United States Patent
Yehle et al.

(10) Patent No.: US 7,387,494 B2
(45) Date of Patent: Jun. 17, 2008

(54) FINGER DOVETAIL ATTACHMENT BETWEEN A TURBINE ROTOR WHEEL AND BUCKET FOR STRESS REDUCTION

(75) Inventors: Gary Edward Yehle, Clifton Park, NY (US); Thomas Joseph Farineau, Schoharie, NY (US); Yavuz Kadioglu, Mechanicville, NY (US)

(73) Assignee: General Electric Company, Schenectady, NY (US)

( * ) Notice: Subject to any disclaimer, the term of this patent is extended or adjusted under 35 U.S.C. 154(b) by 342 days.

(21) Appl. No.: 11/116,186

(22) Filed: Apr. 28, 2005

(65) Prior Publication Data

US 2006/0245927 A1 Nov. 2, 2006

(51) Int. Cl.
*F01D 5/30* (2006.01)

(52) U.S. Cl. ..... 416/217; 416/220 R

(58) Field of Classification Search ..... 416/215, 416/217, 219 R, 220 R, 248
See application file for complete search history.

(56) References Cited

U.S. PATENT DOCUMENTS 4,191,509 A * 3/1980 Leonardi ..... 416/219 R
4,321,012 A * 3/1982 Tan et al. ..... 416/217
5,062,769 A * 11/1991 Ortolano ..... 416/217
5,531,569 A * 7/1996 Seeley ..... 416/222
6,652,237 B2 11/2003 Yehle et al.
6,840,740 B2 1/2005 Yehle et al.

* cited by examiner

*Primary Examiner*—Edward K. Look
*Assistant Examiner*—Devin Hanan
(74) *Attorney, Agent, or Firm*—Nixon & Vanderhye, PC

(57) ABSTRACT

A bucket to wheel dovetail attachment includes axially spaced radially extending wheel fingers having discrete sections of decreased axial thickness in a radial outward direction with transition fillets between sections of different thicknesses. The wheel fingers define wheel finger slots for receiving correspondingly shaped bucket dovetail fingers. Pins interconnect the buckets and rotor wheel. The slot bottoms likewise have fillets. The fillets on the wheel fingers and slot bottoms have a blend of different radii with the larger radii outward of the smaller radii to reduce stress concentrations and to avoid stress corrosion cracking in steam turbine applications.

7 Claims, 2 Drawing Sheets

FINGER DOVETAIL ATTACHMENT BETWEEN A TURBINE ROTOR WHEEL AND BUCKET FOR STRESS REDUCTION

The present invention relates to an attachment between a rotor wheel dovetail and a dovetail on buckets for minimizing the concentrated stress caused by the centrifugal force of the buckets in the wheel fingers and particularly relates to a compound fillet at the wheel finger transition between sections of different radial thicknesses and at wheel finger slot bottom locations for stress reduction for a given set of radii.

BACKGROUND OF THE INVENTION

In turbines, particularly steam turbines, attachment between the plurality of buckets and the rotor wheel is typically accomplished using radial entry bucket dovetail fingers and radial fingers about the margins of the rotor wheel. For example, the finger dovetails on the buckets include a plurality of axially spaced fingers having sections which decrease in thickness in a radial inward direction for reception in slots defined between axially adjacent radially outwardly projecting fingers having sections which decrease in thicknesses in a radial outward direction about the margin of the rotor wheel. Axially extending pins secure the fingers of the wheel and bucket to one another. Single radius fillets are conventionally provided in the wheel fingers at the transitions between the sections of different thicknesses. Similar fillets have been used at the bottom of the finger slots in the wheel.

In many steam turbine applications, the finger dovetails operate in an environment that is conducive to stress corrosion cracking (SCC). SCC is accelerated by the stress levels that are present in the wheel transition fillets and slot bottoms. These stresses are normally acceptable. However in steam turbines having contaminated steam, cracks can initiate and if left undetected, may grow to a depth that will cause failure of the wheel fingers. Experience has shown that wheel dovetail fingers crack while bucket dovetails typically do not crack. This is because the materials used for the rotors are much less resistant to SCC than are the materials used for the buckets. For example, NiCrMoV and similar low alloy steels are typically used in rotors whereas 12 Cr steels are typically used for buckets as those materials afford an optimum combination of properties available for overall low pressure design. Typically a single radius at the wheel transition fillets and slot bottom have been used and these have experienced SCC cracking in the field. Accordingly, there is a need to provide an effective means of avoiding SCC in wheel dovetails which is compatible with existing steam paths, does not affect bucket dovetail geometry and will reduce the stress concentration.

BRIEF DESCRIPTION OF THE INVENTION

In a preferred embodiment of the present invention there is provided a rotor wheel for a turbine comprising: a plurality of fingers spaced axially one from another and extending circumferentially about a margin of the wheel for receiving fingers of buckets; the wheel finger including a plurality of circumferentially extending sections of reduced axial extent in a radial outward direction; each of the wheel fingers having fillets at transitions between radially adjacent sections; each fillet being comprised of first and second radii with the first radii having a larger radius than the second radius.

In a further preferred embodiment of the present invention there is provided a rotor wheel for a turbine comprising: a plurality of fingers spaced axially from one another and extending circumferentially about a margin of the wheel for receiving fingers of buckets; the wheel fingers including a series of circumferentially extending sections of reduced axial extent in a radial outward direction; axially adjacent wheel fingers at radially innermost locations along the wheel margin defining a bottom of a generally dovetail-shaped slot between the adjacent wheel fingers; the bottom of the slot having a pair of fillets with each bottom slot fillet comprised of first and second radii with the first radius of each bottom slot fillet having a larger radius than the second radius thereof.

In another embodiment of the present invention there is provided a rotor wheel and bucket attachment for a turbine comprising: a plurality of fingers carried by the rotor wheel spaced axially from one another and extending circumferentially about a margin of the wheel, the wheel fingers defining wheel finger slots therebetween having a bottom; a plurality of buckets each having a plurality of bucket fingers extending radially into the wheel finger slots; pins extending generally axially through the wheel and bucket fingers to secure the buckets and wheels to one another; the wheel fingers including a plurality of circumferentially extending sections of reduced axial thickness in a radially outward direction; each of the wheel fingers having fillets at transitions between radially adjacent sections and at the bottom of the finger wheel slots, at least one of the fillets for each wheel finger being comprised of first and second radii with the first radius being larger than the second radius.

DETAILED DESCRIPTION OF THE INVENTION

Figure 1:
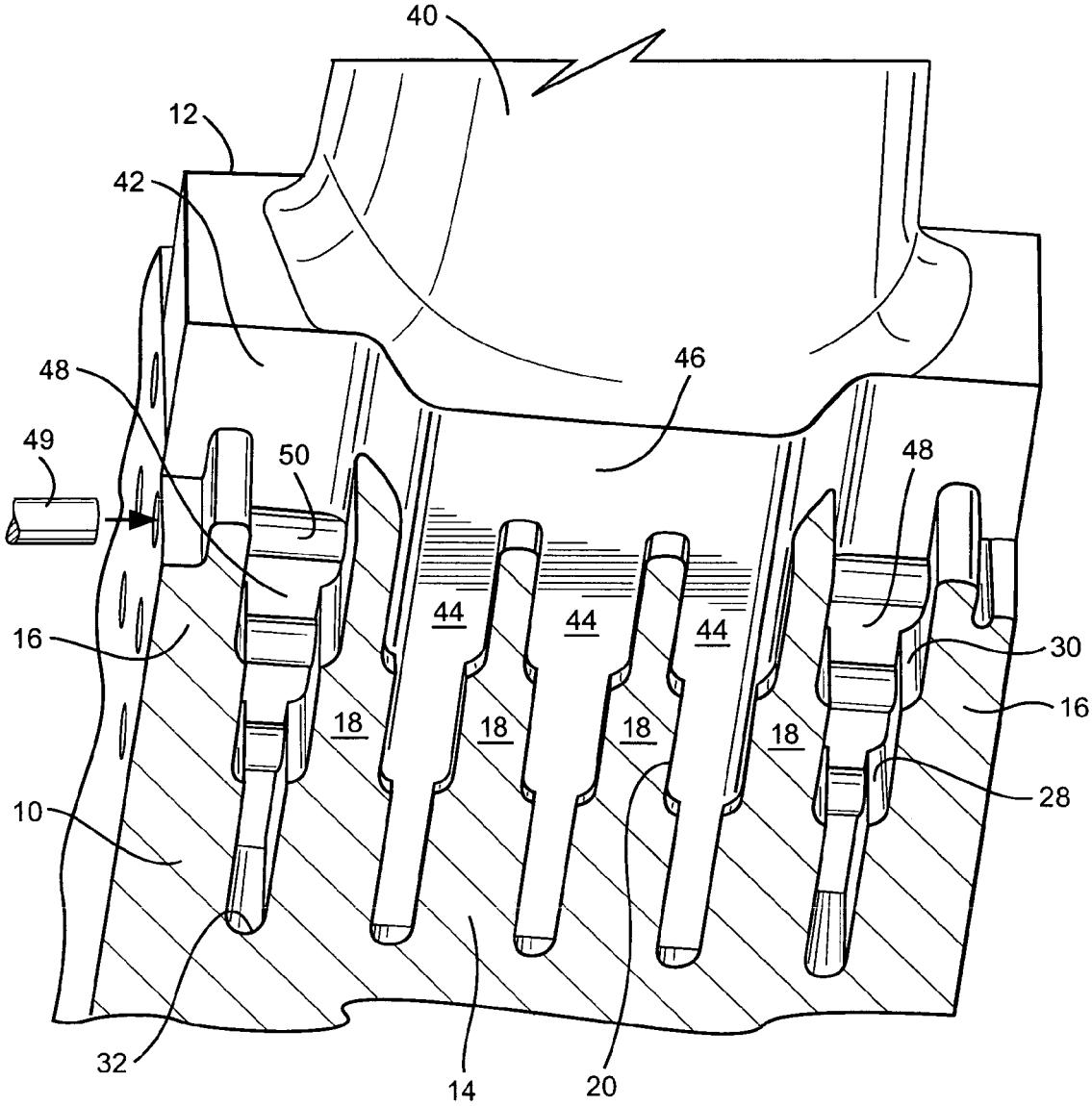
FIG. 1 is a fragmentary perspective view of portions of a bucket and its attachment to the margin of a rotor wheel of a turbine.
Figure 2:
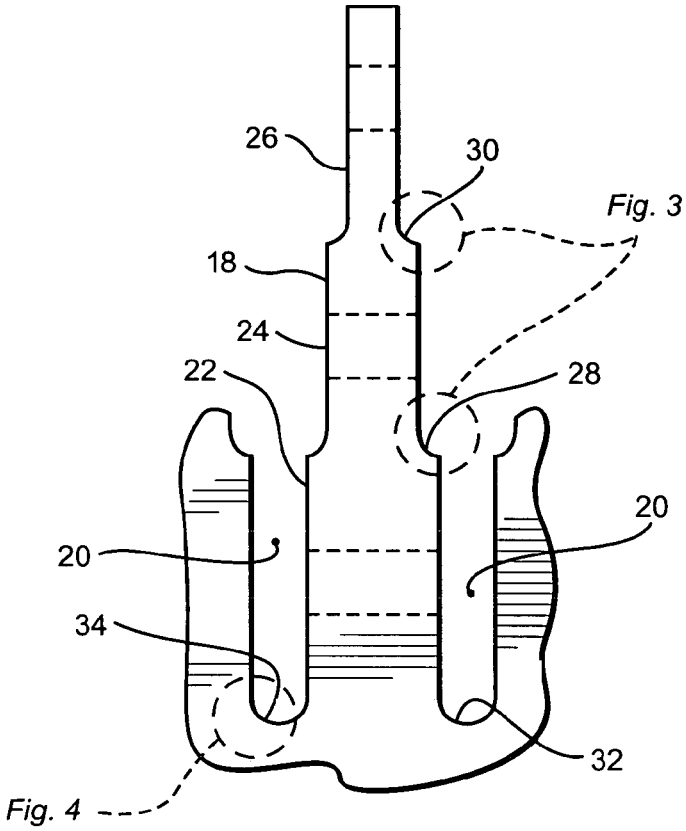
FIG. 2 is an enlarged fragmentary tangential view of the wheel finger dovetails.

Referring now to the drawings, particularly to FIG. 1, there is illustrated a fragmentary portion of the margin of a rotor wheel 10 illustrating the attachment of a plurality of buckets, only one bucket 12 being illustrated, to the rotor wheel. Rotor wheel 10 includes a plurality of radially outwardly extending fingers 14, two end fingers 16 being located along axial opposite sides of the wheel 10. The fingers 14 and 16 form a wheel dovetail. Four intermediate wheel fingers 18 extend between the end wheel fingers 16. The wheel fingers 16 and 18 extend continuously in a circumferential direction about the margin of the wheel and project radially outwardly defining wheel finger slots 20 therebetween. Each wheel finger 18, as best illustrated in FIG. 2, includes a series of circumferentially extending sections or steps of reduced axial extent in a radial outward direction. For example, the wheel finger 18 illustrated in FIG. 2 includes reduced thickness sections 22, 24 and 26 with the reductions in thickness being stepped radially outwardly. A fillet 28 forms a transition between the thickest section 22 and the intermediate section 24 on each of the opposite sides of each wheel finger. A fillet 30 also forms a transition between the intermediate thickness section 24 and the final radial outwardly thinnest section 26 on each of the opposite sides of each wheel finger. Referring back to FIG. 1, it will be appreciated that the end wheel fingers 16 similarly have fillets 28 and 30 along their axially inside surfaces at the transitions between the sections of different axial thickness.

Also as best illustrated in FIG. 2, the slots 20 between the adjacent wheel fingers 18 and between the end wheel fingers 16 and axially outermost intermediate wheel fingers 18 terminate at their radial inner ends in bottom slots 32. Bottom slots 32 define fillets 34 with the side wall surfaces of the adjacent wheel fingers.

Each bucket 12 includes an airfoil 40 having a root or base 42 from which project radially inwardly a plurality of dovetail-shaped fingers 44. The fingers 44 are generally complementary in shape to the finger slots between adjacent intermediate wheel fingers 18. The base 42 of each bucket 12 has a recess, not shown, on one side and a tangential projection 46 along its opposite side. The intermediate fingers 44 lie flush with the surfaces of the recess and projection 46.

Bucket 12 also includes end fingers 48 on adjacent axially opposite sides of the bucket. The end fingers 48 are thus tangentially offset from the intermediate bucket fingers 44. The end fingers 48 have a plurality, three being preferred, of semi-cylindrical openings 50. Each of the intermediate fingers 44 of the bucket 12 has a full circular opening coaxial with the semi-circular openings 50. Additionally, the wheel fingers 16 and 18 have circular openings aligned with the semi-circular end bucket fingers 48 and the circular openings of the intermediate bucket fingers 44. Thus, when the buckets are inserted radially onto the rotor wheel 10, the bucket fingers and the wheel fingers interdigitate with the openings aligned axially relative to one another. Pins 49 may thus be received within the aligned openings and secured to maintain the attachment between the buckets and the rotor wheel. It will be appreciated that adjacent buckets have end fingers 48 with semi-cylindrical openings and the adjacent buckets therefore share the pins with one another in that region.

Figure 3:
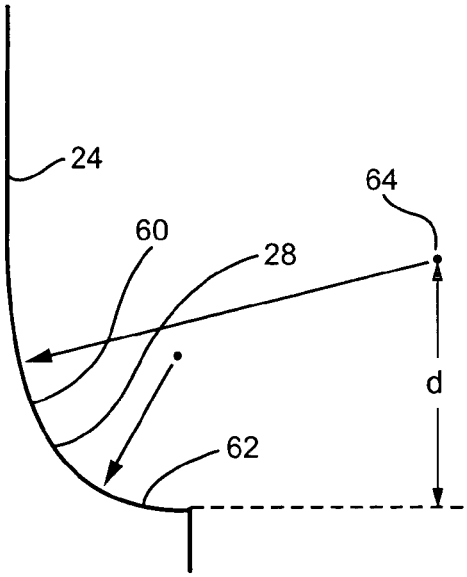
FIGS. 3 AND 4 are enlarged fragmentary views of the fillets at the transitions of the wheel finger sections of different thicknesses and at the bottom of the slots, respectively.

As noted previously, the wheel finger dovetails of conventional turbines have a single radius at each of the transitions between the sections of the fingers of different thicknesses and at the bottoms 32 of the finger slots. In a preferred embodiment of the present invention, there is provided at each wheel finger transition area location a compound fillet to reduce the stress. It will be appreciated that the airfoil and bucket dovetail carry a centrifugal loading through the pins which secure the buckets and the wheel to one another. These forces give rise to stress in the wheel dovetail and peak stresses in the fillets and slot bottom region of the wheel fingers. In a preferred aspect of the present invention, a compound fillet 61 is used, i.e. a fillet having a first large radius 60 and a second smaller radius 62. For example as illustrated in FIG. 3 showing transition fillets 28 between wheel finger sections 22, 24 and 24, 26, the large radius 60 blends into the side surface of the adjacent finger and blends into the smaller radius 62. As a representative example, the large radius may be 0.225 inches while the small radius may be 0.080 inches. The distance d from the large radius center 64 is 0.130 inches. Thus the larger radius 60 lies radially outwardly of the smaller radius 62. From a stress concentration standpoint, the larger radius is accordingly more resistant to stress/

Figure 4:
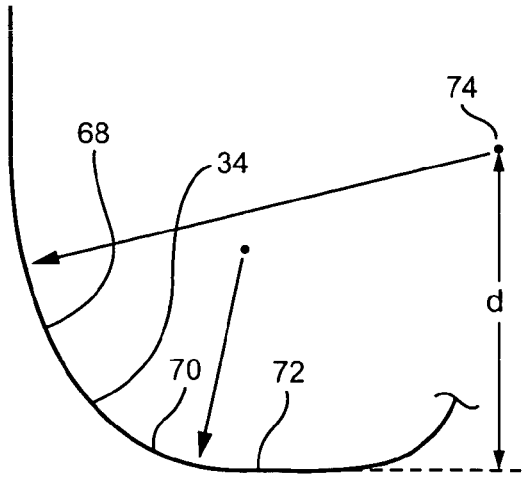

Additionally, referring to FIG. 4, each fillet forming the bottom 32 of each slot similarly has a compound fillet. For example the fillet 34 includes a large radius 68 and a smaller radius 70. Each large radius section 68 transitions into the side wall of the base of the wheel fingers 18 or 16 while each small radius 70 transitions from the larger radius 68 into a small flat 72 at the base of the slot bottom 32. The large radius 68 may, for example, be 0.225 inches and the small radius 70 0.080 Inches. The center of the large radius may be 0.146 inches in a radial direction from the bottom of the slot. The flat may extend axially a distance of about 0.16 inch.

By the foregoing geometry, the bucket to wheel finger dovetail configuration has peak stresses at the wheel finger transition locations and bottom slots sufficiently low to avoid stress corrosion cracking of the wheel fingers. Also and significant from manufacturing and operational standpoints, the compound fillets at the transition areas and bottom slot locations are compatible with existing steam paths and do not affect bucket dovetail geometry thus enabling a reduction in stress in the wheel fingers without changes to the configuration of the buckets.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotor wheel for a turbine comprising:

a plurality of fingers spaced axially one from another and extending circumferentially about a margin of the wheel for receiving fingers of buckets;

said wheel fingers including a plurality of circumferentially extending sections of successively reduced axial extent in a radial outward direction;

each of said wheel fingers having fillets at transitions between radially adjacent sections;

each wheel finger fillet being comprised of first and second radii with the first radius having a larger radius than the second radius; and wherein axially adjacent wheel fingers at radially innermost locations along the wheel margin define a bottom of a generally dovetail-shaped slot between the adjacent wheel fingers, the bottom of said slot having a pair of fillets with each bottom slot fillet comprised of first and second radii with the first radius of each bottom slot fillet having a larger radius than the second radius thereof, wherein the bottom of said slot includes a flat extending axially and circumferentially between the second radius of each of said pair of bottom slot fillets.

2. A wheel according to claim 1 wherein said larger first radius of said wheel finger fillets lies along said wheel finger radially outwardly of said second radius of each of said wheel finger fillets at each fillet location.

3. A rotor wheel according to claim 1 wherein the first radius of each bottom slot fillet lies radially outwardly along the wheel finger radially outwardly of the second radius of said bottom slot fillet.

4. A rotor wheel for a turbine comprising:

a plurality of fingers spaced axially from one another and extending circumferentially about a margin of the wheel for receiving fingers of buckets;

said wheel fingers including a plurality of circumferentially extending sections of successively reduced axial extent in a radial outward direction;

axially adjacent wheel fingers at radially innermost locations along the wheel margin defining a bottom of a generally dovetail-shaped slot between the adjacent wheel fingers;

the bottom of said slot having a pair of fillets with each bottom slot fillet comprised of first and second radii with the first radius of each bottom slot fillet having a larger radius than the second radius thereof, wherein the first radius of each bottom slot fillet lies outwardly along the wheel finger radially outwardly of the second radius thereof, and wherein the bottom of said slot includes a flat extending axially and circumferentially between the second radius of each of said pair of bottom slot fillets.

5. A rotor wheel and bucket attachment for a turbine comprising:

a plurality of fingers carried by said rotor wheel spaced axially from one another and extending circumferentially about a margin of the wheel, said wheel fingers defining wheel finger slots therebetween having a bottom;

a plurality of buckets each having a plurality of bucket fingers extending radially into said wheel finger slots;

pins extending generally axially through said wheel and bucket fingers to secure the buckets and wheels to one another;

said wheel fingers including a plurality of circumferentially extending sections of reduced axial thickness in a radially outward direction;

each of said wheel fingers having fillets at transitions between radially adjacent sections and at the bottom of the finger wheel slots, wherein the fillets at the bottom of each finger wheel slots are compound-radius fillets separated by a flat.

6. An attachment for a turbine according to claim 5 wherein each of the fillets at the transitions between radially adjacent sections have said first and second radii, with the first radius larger than the second radius.

7. An attachment for a turbine according to claim 6 wherein each of said larger first radii lies along said wheel fingers radially outwardly of said second radii at each fillet location.

* * * * *